United States Patent [19]

Golen

[11] Patent Number: 5,042,212

[45] Date of Patent: Aug. 27, 1991

[54] SECURITY CLOSURE ASSEMBLY

[76] Inventor: Selig Golen, 5137 NW. 93 Doral Way, Doral Estates, Miami, Fla. 33178

[21] Appl. No.: 527,308

[22] Filed: May 23, 1990

Related U.S. Application Data

[63] Continuation-in-part of Ser. No. 243,292, Sep. 12, 1988.

[51] Int. Cl.[5] ..... E04B 1/62

[52] U.S. Cl. ..... 52/397; 52/403; 52/773

[58] Field of Search ..... 52/397, 773, 775, 780, 52/781, 476, 402, 403, 766

[56] References Cited

U.S. PATENT DOCUMENTS

| | | | |
|---|---|---|---|
| 985,800 | 3/1911 | Hartbauer . | |
| 3,423,897 | 1/1969 | Birum, Jr. . | |
| 3,487,601 | 1/1970 | James . | |
| 3,704,563 | 12/1972 | Waller . | |
| 4,115,964 | 9/1978 | Montrouil . | |
| 4,463,535 | 8/1984 | Wendt . | |
| 4,525,966 | 7/1985 | Litchfield . | |
| 4,614,062 | 9/1986 | Sperr | 52/403 X |
| 4,621,478 | 11/1986 | Phillips et al. . | |

FOREIGN PATENT DOCUMENTS 426046 3/1935 United Kingdom .

*Primary Examiner*—David A. Scherbel
*Assistant Examiner*—Creighton Smith
*Attorney, Agent, or Firm*—Malloy, Downey & Malloy

[57] ABSTRACT

A closure assembly preferably in the form of a glass panel door or window structure which disposed in spanning and covering relation to any type of applicable opening such as a door or window opening of a building structure and further wherein each of the top, bottom and sides of the support frame embrace the correspondingly positioned peripheral edges of the glass panel in a manner which conceals any stop element, associated with the retention of the glass panel in the support frame, so that it is not noticeable to the eye of an observer and is in an inaccessible location thereby preventing or seriously reducing the possibility of unauthorized entry by removal of the aforementioned stop structures possible with prior art closures of this type, and improving the appearance of the assembly.

4 Claims, 2 Drawing Sheets

10
10'
12
12'
14
16
17
18
20
22
4
5
6
7
50
52
54
56
58
60
62
64
66
70
73
75

SECURITY CLOSURE ASSEMBLY

BACKGROUND OF THE INVENTION

This is a continuation-in-part of my earlier filed U.S. Patent Application Ser. No. 07/243,292, filed Sept. 12, 1988.

FIELD OF THE INVENTION

This invention relates to a security door or window structure of the type including a substantially centrally disposed glass panel surrounded and supported by an extruded material support frame wherein the frame is structured and connected to the panel in a manner which reduces the possibility of unauthorized entry by removal of the glass panel from an exterior location thereof, and which is of a structure which improves the appearance of the assembly.

DESCRIPTION OF THE PRIOR ART

Extruded material, such a aluminum frame structures used to peripherally support and engage glass or like material panels in doors, windows or like closure assemblies are, of course, well known in the art. Typically, the various components of the supporting frame are secured together in a manner to receive, engage and support the peripheral edges continuously about the circumference of the glass panel. In order to accomplish this and further in order to facilitate mounting of the glass panel in the aforementioned manner to the surrounding support frame, it has been common practice in the prior art to use elongated panel stops. Such stops are secured to the inner periphery of the frame components in an exposed position and in overlapping and retaining engagement to the outer surface of the glass panel. The peripheral edges of the supported glass panel are thereby adequately secured and effectively engaged in a sandwiched relation between inner and outer glass panel stops which are, as set forth above, exposed both from an exterior and interior position on opposite sides of the closure. While comprising an effective way of mounting the panel to the support frame, such prior art structures frequently sacrifice security, and do not present a smooth appearance, compare the prior art FIG. 3 with FIG. 2 illustrating an embodiment of the invention. The exposure of the elongated glass panel stops, especially from an exterior location of the formed closure, not only facilitates the removal of the glass panel stops from an outer or exterior surface of the closure by unauthorized personnel, but, also, disturbs a view of the closure by additional lines when the closure is observed. Typically, the glass panel is removed from the frame by forcing removal of such glass panel stops from the frame structure thereby allowing authorized personnel to pass through the central opening in which the panel is mounted once such glass panel has been removed. This eliminates the need for any unauthorized personnel to break the glass panel which in many instances is not only difficult, but frequently dangerous to the unauthorized person as well as being cumbersome and noisy. It is acknowledged, therefore, that while the prior art structures are desirable from a manufacturing standpoint, such structures may be highly undesirable from a security standpoint and aesthetic point of view.

Numerous prior art frame structures for doors, windows, etc. incorporating glass or like material panels are demonstrated in the following U.S. Pat. No. 4,004,641 to R. C. Johnson; U.S. Pat. No. 4,078,288 to Abramson; U.S. Pat. No. 4,387,542 to Wehr; and U.S. Pat. No. 4,628,648 to Winyard.

Based on the above, there is still a recognized need for a framing structure for a glass panel door or window which enhances the security of any building in which such closure assembly is mounted. At the same time, a preferred framing structure facilitates mounting of the glass panel in the central opening of the support frame while securing any glass panel stop structures in an unexposed and generally inaccessible location from the outer face of the closure. This construction also results in a smoother, more aesthetically pleasing appearance.

SUMMARY OF THE INVENTION

The present invention is directed to a security closure assembly designed specifically to be positioned in covering relation to a portal, opening or the like in a building. The structural features of the present invention to be described in greater detail hereinafter are adaptable both for the utilization and construction of either a door or window-type closure assembly.

More specifically, the subject closure assembly includes a support frame having a plurality of components including two spaced apart, preferably parallel side portions and a spaced apart top and bottom portion wherein each of the various side, top and bottom portions are interconnected to one another to define a support frame in surrounding relation to what may be considered a generally central opening in which a glass or like, applicable material panel is mounted and supported. In typical fashion, the glass panel normally takes up a vast majority of the longitudinal and transverse dimension of the given door or window structure defining the closure assembly and the various portions of the support frame are disposed in surrounding relation thereto so as to engage and extend continuously along the peripheral edges of the glass panel.

The present invention is directed to a security feature of the subject closure assembly wherein the means to facilitate both placement and supporting engagement of the glass panel in the appropriate location surrounded by the support frame is such as to dissuade and render more difficult any unauthorized removal of the glass panel from the support frame so as to accomplish unauthorized entry through the aperture in which the glass panel is supposed to be mounted.

Typical with prior art closure structures of the general types set forth herein, such glass or like material panels were mounted and/or retained in supported relation on the support frame through the provision of a plurality of elongated "panel stops" mounted on the various portions of the support frame in retaining relation to the glass panel by abutting or overlapping an exposed surface thereof. Accordingly, the panel stops were themselves exposed even to the exterior side or face of the closure. Unauthorized personnel, attempting to obtain illegal and/or unauthorized entry would have a tendency to force removal of these panel stops from their retaining engagement relative to the exposed outer surface of the glass panel. This, in turn, would render removal of the glass panel much easier and eliminate the need to break the glass panel which itself would be undesirable to the unauthorized person for a variety of obvious reasons.

To the contrary, the support frame defined by the interconnected and surrounding frame portions serves to engage and retain corresponding peripheral edges of the glass panel in a manner which eliminates any direct exposure of the glass panel stops by making such stop structure inaccessible from the exterior of the closure. The exposed retaining portion serving to overlap the outer surface of the glass panel immediately adjacent the peripheral edges thereof are integral formations of the frame components themselves. Accordingly, attempted removal of the glass panel in this manner would necessitate the destruction or removal of the entire side, top and/or bottom portions of the frame which would be exceedingly more difficult, if not impossible.

In certain specific and preferred embodiments described in detail hereinafter, the frame structure of the present invention may incorporate the use of the glass panel stops but the positioning of such stops in an exposed location only on an interior face of the panel and support frame. Alternately, the panel stop structures are disposed almost entirely on the interior of certain frame portions thereby rendering them inaccessible from any exterior location.

As seen in FIG. 3, the prior art is exemplified by additional lines as seen by an observer in contrast with the more secure and aesthetically appealing view as seen in FIG. 2.

BRIEF DESCRIPTION OF THE PRIOR ART

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed towards a security closure assembly such as a door or window. For purposes of clarity and explanation, specific reference will be made more to a door construction. However, it should be emphasized that the structural features as defined herein are also applicable to a window structure as well as a door structure.

Figures 1, 2, 3, 4:
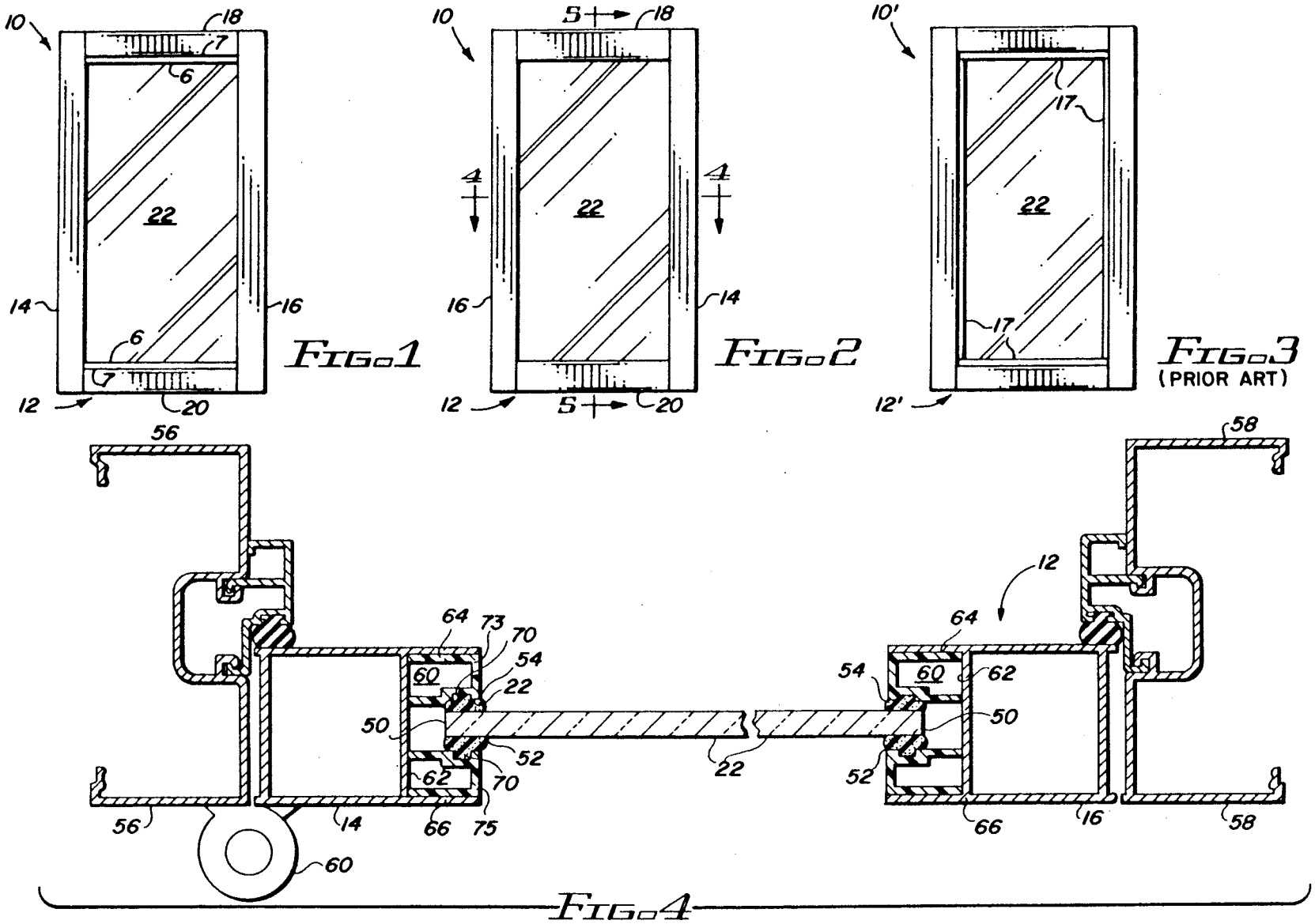
FIG. 3 (PRIOR ART)
FIG. 1 is a front elevation view of an inner face or surface of a closure assembly of the present invention in the form of a door.
FIG. 2 is a front elevation view of an exterior face or surface of the subject closure assembly.
FIG. 3 is a front elevation view of an exterior surface of a prior art door structure as labeled.
FIG. 4 is a transverse sectional view of the door assembly of the present invention.

FIGS. 1 and 2 represent the closure assembly of the present invention in the form of a door generally indicated as 10 wherein an inner surface is represented in FIG. 2. The inner and outer surfaces respectively may be defined by those surfaces or faces of the closure door 10 which would be respectively exposed to the inside of a building and the exterior of a building. As can be seen, the closure assembly or door of the present invention comprises a support frame generally indicated as 12 including a plurality of frame portions such as two spaced apart side portions 14 and 16, a top portion 18 and a bottom portion 20. As shown, each of the above noted frame portions are interconnected to one another so as to surround and thereby support a panel 22 preferably made of a glass or like applicable material. The glass panel 22, therefore, has its entire periphery engaged and supported by the frame structure 12 including the various side portions 14, 16 and the spaced apart top and bottom portions 18 and 20, respectively. As is known in the prior art, the present invention has the various frame portions formed from elongated extruded material, such as aluminum, interconnected to one another in a conventional fashion. However, structural features do exist in the support frame 12 and the portions as outlined above which enable a more secure structure when the door 10 is placed in covering relation to any type of portal or opening of a building as intended. Such structure reduces the possibility or renders practically impossible the removal of the glass panel 22 from its supported position relative to the frame from an exterior surface or location as represented in FIG. 2. It would be noted that the only exposed structural features from the outside face or surface as shown in FIG. 2 is the outside surface of the glass panel 22 and the surfaces of the side frame portions 14 and 16 as well as the top and bottom portions 18 and 20. This should be contrasted with FIG. 3 wherein a prior art door structure is represented. In the prior art FIG. 3, the door 10' includes similar support frame structure 12' defined by a plurality of portions on the top and side generally as outlined with regard to the preferred embodiment of the present invention as shown in FIGS. 1 and 2. However, one conventional and well recognized practice of mounting the glass panel 22' in its supported position surrounded by the frame portions of the support frame 12 is to first place the glass panel in the already interconnected frame portions. After such positioning, a plurality of glass stops or stop structures 17 are interconnected to the respectively positioned framed portions in overlapping relation to the exterior or outer surface of the glass panel 22 immediately adjacent to the peripheral edge thereof. However, one problem associated with this type of prior art structure is the relative ease in forcing removal of the exposed glass stop structure 17 from their retaining position relative to the glass panel. This is done for the purpose of then subsequently removing the glass panel 22 from the support frame 12' and accomplishing illegal and unauthorized entry through the aperture in the middle of the support frame 12' previously occupied by the glass panel. Also, the additional lines as seen on comparing FIG. 3 with FIG. 2, in which they do not appear, gives the closure of the present invention as smoother, neater appearance.

To the contrary, in comparison with FIG. 2, the preferred embodiment of the door structure 10 of the present invention shows that there are no exposed glass stop or stop structures accessible from the outside of the door structure 10. Therefore, any unauthorized person would find it very difficult if not impossible to remove the panel 22 from the peripheral engagement with the support frame 12 without dismantling the frame itself or having to break the glass panel 22. It should be obvious, therefore, that an enhanced appearance as well as added security are thereby provided using the closure assembly, either in the form of the door 10 or a window structure, to be described in greater detail hereinafter, of the present invention.

Figure 5:
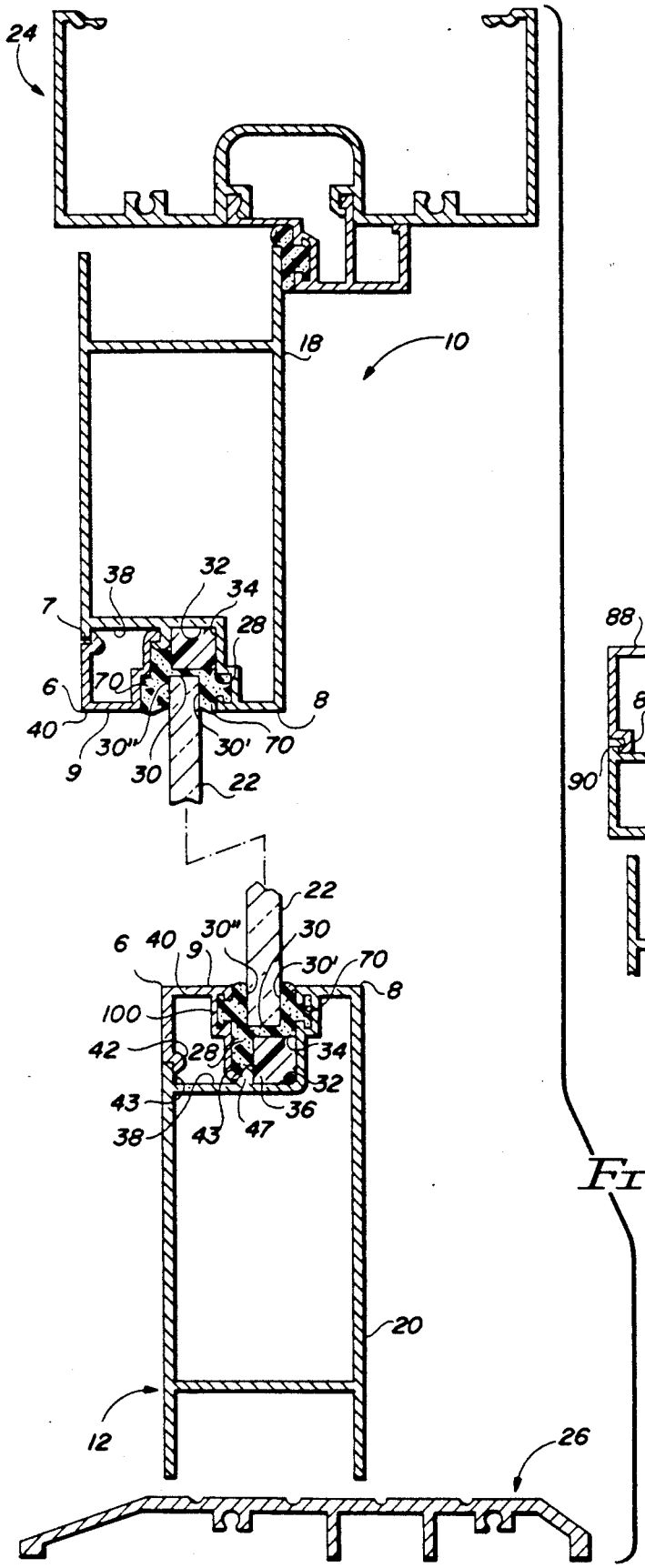
FIG. 5 is a longitudinal sectional view in partial cutaway of the closure assembly of the present invention.

With reference to FIGS. 4 and 5, structural details of interconnecting the glass panel 22 to the aforementioned portions of the support frame 12 are shown in detail. First, with regard to FIG. 5, a longitudinal sectional view in partial cutaway shows the upper or top frame portion 18 being formed from an elongated extruded aluminum or other applicable material disposed in cooperative relation to a header portion generally indicated as 24 of a door frame or the like. Similarly, a foot plate generally indicated as 26 forms the bottom portion of a door frame in adjacent and/or cooperative relation to the bottom portion 20. The bottom portion 20, as set forth above, is also formed from an elongated extruded aluminum material wherein both the top and bottom portions 18 and 20 extend substantially across the entire transverse dimension of the door.

A first receiving channel 28 is formed along the inner edge of both of the top and bottom portions 18 and 20 as clearly shown in FIG. 5. Such receiving channel is specifically disposed to receive therein the corresponding peripheral edge 30 of the glass panel 22 for supported engagement therewith. The receiving channel 28 includes a base 32 defined by an integral one-piece construction with the remainder of the upper and lower portions respectively. Each of the first receiving channels 28 are also formed by an outer side 34 which is also formed by an integral one-piece construction with the remainder of the respective top and bottom portions 18 and 20. It is important to note that the disposition and dimension of the outer side 34 of each of the first receiving channels 28 is disposed to extend outwardly in substantially overlapping relation to the corresponding peripheral edge 30 of the glass panel 22 but the surface as at 30' immediately adjacent to the peripheral edge 30. The base 32 of each of the first receiving channels 28 is disposed in somewhat transverse relation to the plane of the glass panel 22 and for ease of assembly, an inner stop or orienting structure 36 is disposed in near abutting relation between the corresponding peripheral edge 30 and in abutting engagement with the base 32 so as to properly orient and help in the retaining of the panel 22 in the desired position as shown in FIG. 5.

The inner stop or orienting structure 36 facilitates the placement of the glass panel 22 in the door frame during assembly and especially relative to the upper and lower frame portions 18 and 20. Also, each of the first receiving channels 28 include an open inner side 38 which is "occupied" by the placement of a glass or panel stop structure 40 against and in retaining relation to the inner surface 30'' of the glass panel 22 so as to maintain the glass panel 22 in the aforementioned intended position. Due to the fact that the stop structure 40 is not placed in the operative position as shown in FIG. 4 until after the glass panel 22 is properly positioned, the actual installation and connection of the glass panel and particularly, the respective corresponding peripheral edges thereof in the receiving channels 28 is greatly facilitated. This is true since the inner side 38 of each of the first receiving channels 28 is in fact open until it is occupied by the elongated extruded material stop structure or elements 40. The material from which the stop structures 40 are formed may be aluminum, plastic or any other applicable material As shown, the surfaces 8 are coplanar with the surfaces 9, so that only lines 6 and 7 appear from the inside view Further, specific integral fingers and the like as at 42 may be molded thereon for cooperative relation with a crotch or receiving channels 43 such that each of the stop structures 40 effectively "snap-fit" into their retaining, operative position as clearly shown in FIG. 5. As indicated in FIG. 5, the outer surface of the glass panel 22 is indicated as at 30' and the inner surface as at 30''. It should be apparent that access to the panel stop structure 40 from the exterior of the building or outside face of the door structure 10 is impossible. Therefore, unauthorized removal of the glass panel 22 would be made extremely more difficult and any unauthorized personnel would be forced to break the glass panel or to attack one or more of the frame portions 14, 16, 18 and 20. It is thus seen that only a single line results from the structure as viewed looking toward the outer surface 30' of the glass panel, also see FIG. 2, which results in a neat, smooth appearance of the closure.

With regard to FIG. 4, side portions 14 and 16, being spaced apart from one another and representing the side peripheries of the support frame serve to supportingly engage the correspondingly disposed panel edges 50. An inner surface, located on the interior of the building, is represented as at 52 and an outer surface located on the exterior of the building is represented as at 54. Each of the side portions 14 and 16 cooperate with corresponding and substantially conventional portions of a side of a door frame as at 56 and 58. A hinge structure 60 may be interconnected between the frame portion 56 and the side portion 14 of the support frame 12 so as to allow pivotal movement of the door 10 into and out of its closed position relative to the opening in the building which it is intended to fill. Each of the side portions 14 and 16 are formed from an elongated extruded aluminum or like material extending substantially along the entire dimension of the door on opposite sides thereof and, depending upon the overall configuration of the panel 22, the side portions 14 and 16 are generally disposed in parallel relation to one another. In either event, the inner longitudinal edges or ends of the side portions 14 and 16 each have a second receiving channel 60 formed therein and at least partially defined by a base 62 located transverse to the respective peripheral edges 50 of the panel 22. In addition, each of the second receiving channels 60 is defined by an outer side 4 and an inner side 66. Both the outer and inner side 64 and 66 as well as the base 62 of each second receiving channel 60 are defined by an integral, one-piece construction with the remainder of the respective side portions 14 and 16 of the support frame. It is noted that the terminal ends of the inner and outer sides 64 and 66 are coplanar.

Further, each of the sides 64 and 66 extend outwardly from the base 62 a sufficient distance to extend beyond the corresponding peripheral edge 50 of the panel 22 in a somewhat overlapping, but in spaced relation to the respective outer and inner surfaces 54 and 52 respectively of the glass panel 22. The spacing between the respective sides 64 and 66 and the respective surfaces 54 and 52 is such to allow placement therein of two second glass or panel stop structures 73 and 75. Each of these stop structures 73 and 75 are placed in overlapping retaining relation to the glass panel 22 and more specifically, to the outer and inner surfaces 54 and 52 respectively of the panel 22 in retaining relation thereto such that the panel is sandwiched therebetween for retention. As is the norm, the glass panel 22 and particularly, the corresponding peripheral edges 50 thereof are "angled" or "skewed" into proper position relative to the side portions 14 and 16 of the support frame and more specifically, the second receiving channel 60 thereof. Initially, each of the second receiving channels 60 has a sufficient transverse dimension between outer and inner sides 64 and 66 to allow the aforementioned angled orientation or skewing of the edges 50 of the glass panel 22 in order to properly orient it in the intended position as shown both in FIGS. 4 and 5. Once properly positioned, however, the two second glass or panel stop structures 73 and 75 are disposed in the retaining position as shown in FIG. 4 such that the edges and the outer and inner surfaces 54 and 52 of the panel 22 are properly sandwiched and thereby retained therebetween. The dimensions and configurations of the stop members 73 and 75 are such as to fit entirely within the second receiving channel 60 on opposite sides of the panel 22 so as to be concealed from both the outer side or surface of the panel 52 as at 54 and the inner side of the panel 52 so as to prevent clear access to either of the stop elements from the exterior or interior of the building. This, again, is provided to add security and eliminate or reduce the possibility of removing such stop structures 73 or 75 in an effort to remove the glass panel from the frame to accomplish illegal or unauthorized entry and to provide a smooth appearance, contrast FIG. 2 with FIG. 3 once again.

Another feature of the structure of FIG. 5 includes the stop structures 73 and 75 permanently or fixedly molded or secured in place so as to be a permanent part thereof. Security is additionally added through this feature.

In the structure of FIGS. 4 and 5, it should be emphasized that adequate and substantially conventional sealing strips 70 are provided to accomplish weather proofing and liquid tight seals between cooperatively positioned surfaces.

Figure 6:
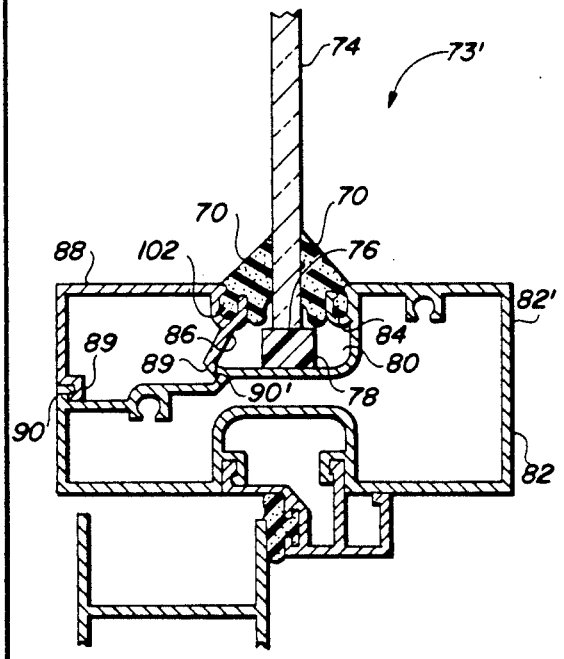
FIG. 6 is a detail view of another embodiment of the present invention in partial cutaway and section.

Yet another embodiment of the present invention is shown in FIG. 6 generally representing a construction associated with a closure assembly 73' which may best be associated with a window structure. In such an embodiment, the glass panel 74 has a corresponding peripheral edge 76 engaging an internal stop or orienting means 78 wherein the stop is mounted within a receiving channel as at 80 which is formed in frame portion 82 being part of a support frame of a window structure. The outer surface is represented as at 82' wherein the receiving channel 80 is defined by a closed outer side 84 and an open outer side 86 occupied, after proper placement of the glass panel 74 by an elongated stop element 88. The stop element 88 is snap-fitted into position due to the cooperative relation and structure of the mounting fingers 89 formed on the stop element 88 and on the frame portion 82 as at 90'. Similar to the embodiments of FIGS. 4 and 5, a proper or adequate sealing strip 70 may be provided to provide adequate weather proofing. It should be seen, therefore, that the stop element 88 is inaccessible from the outer surface as at 82' of the window structure and particularly, the frame portion 82 thereof.

As clearly shown, specifically, in FIGS. 5 and 6, each of the stop elements 40 and 88 respectively include an integrally formed channel 100 and 102 respectively extending along an opposite longitudinal edge of the respective first stop members 40 and 88 and substantially oppositely disposed relative to the fingers 42 and 89. These channels 100 and 102 are specifically structured and disposed to grippingly engage somewhat conventional sealing strips 70 and further position such sealing strips into sealing engagement with an inner most surface of the respective panels 22 and 74.

Further, the opposite longitudinal edge or side of the respective first stop elements 40 and 88 as at 42 and 89 are disposed to matingly engage, along their length an outer projection 47 in FIG. 5 and 90' in FIG. 6 which extends upwardly from the respective bases of the first receiving channels. This engagement serves to further define the aforementioned snap-fit engagement or connection with the outwardly extending fingers 42, 43 in FIG. 5, and 89, 90 in FIG. 6.

Now that the invention has been described,

What is claimed is:

1. A security closure assembly designed to cover an appropriately sized opening in a building such as a door or window opening, said closure assembly comprising:

a. a support frame disposed on and defining a periphery of said closure assembly and comprising a plurality of frame portions including two space apart, elongated side portions and spaced apart, elongated top and bottom portions, b. a substantially centrally disposed panel mounted on said frame and disposed to have its peripheral edges thereof supportingly engaged by said frame portions, said frame portions being connected to one another in collectively surrounding relation to said panel, c. a first receiving channel formed along the length of each of said top and bottom portions and being disposed to receive a corresponding peripheral edge of said panel therein, d. each of said first receiving channels at least partially defined by an open inner side, a base and a closed outer side, said base and said outer side integrally formed on said frame and respectfully disposed in transverse relation to the corresponding peripheral edge of the panel and in overlying relation to an outer surface of said panel immediately adjacent the corresponding peripheral edge thereof, e. an orienting means between the base outer side and the peripheral edge to aid in assembly of the closure assembly, f. a stop structure means having an elongated configuration and connectable to each of said first receiving channels within said open inner side and being inaccessible from an outer surface of said panel, g. said stop structure means and each of said open inner sides each including a correspondingly positioned and outwardly extending finger integrally formed thereon and extending along the length thereof, said fingers cooperatively disposed and configured for locking engagement with one another along the respective lengths of said stop structure means and open inner side and defining a snap-fit engagement of said first stop structure means into said open inner side to captivate the peripheral edge of the panel in the first receiving channels of said top and bottom portions, h. sealing means in the receiving channels between the base, outer side, orienting means and stop structure means, i. a second receiving channel formed along the length of each of said side portions and being disposed and dimensioned to receive a corresponding peripheral edge of said panel therein, each of said second receiving channels including an integrally attached base disposed in transverse relation to the corresponding peripheral edge of said panel and an outer side and an inner side being disposed in parallel relation to one another and integrally formed with said base on said side portion in overlapping and spaced relation to an outer and inner surface of said panel respectfully; two stop structures mounted in each of said second receiving channels on opposite sides of said panel in retaining relation of said panel and adjacent the corresponding peripheral edge and completely between said outer surface and said outer side and between said inner surface and said inner side, respectively, being of a transverse dimension sufficient to fit substantially entirely within a corresponding one of said second receiving channels and in an unexposed position relative to either an outer or inner side of said support frame, j. each of said stop structure means further including an elongated chamber formed therein and disposed substantially adjacent to the inner surface of the panel, each of said chambers structured to grip said sealing means therein and position the sealing means in engaging relation to the inner surface of the panel, and k. said stop structure means in each of said first receiving channels being disposed in an exposed relation on the inner side of said panel along the length of said top and bottom portions of said frame.

2. An assembly as in claim 1 wherein an opposite longitudinal edge of each of said stop structure means relative to said outwardly extending finger thereon is disposed in engaging relation with an outwardly projecting portion of said base of said first receiving channel to further define said snap-fit connection of each of said stop structure means and said open inner side.

3. An assembly as in claim 1 wherein said two second stop structures of each receiving channel are permanently fixed within said second receiving channel, the corresponding peripheral edge of the panel being sandwiched between said two second stop structures.

4. An assembly as in claim 2 wherein said base and said outer side of each of said first receiving channels are in integral, one-piece construction with a remainder of respective ones of said top and bottom portions.

* * * * *